US006716044B2

(12) United States Patent
Bertke

(10) Patent No.: US 6,716,044 B2
(45) Date of Patent: Apr. 6, 2004

(54) EJECTABLE ELECTRICAL CONNECTOR AND METHOD OF USE

(75) Inventor: Patrick J. Bertke, Columbus, OH (US)

(73) Assignee: Trident Design LLC, Columbus, OH (US)

( * ) Notice: Subject to any disclaimer, the term of this patent is extended or adjusted under 35 U.S.C. 154(b) by 0 days.

(21) Appl. No.: 10/266,441

(22) Filed: Oct. 8, 2002

(65) Prior Publication Data

US 2003/0032318 A1 Feb. 13, 2003

Related U.S. Application Data

(63) Continuation-in-part of application No. 09/901,248, filed on Jul. 9, 2001.

(51) Int. Cl.[7] ..... H01R 13/62
(52) U.S. Cl. ..... 439/160; 439/159
(58) Field of Search ..... 439/160, 159

(56) References Cited

U.S. PATENT DOCUMENTS

| | | | | |
|---|---|---|---|---|
| 2,051,425 A | 8/1936 | Schlums | 439/160 |
| 2,134,345 A | 10/1938 | Sheeran | 439/160 |
| 2,551,533 A | 5/1951 | Gernheuser | 439/160 |
| 4,042,292 A | 8/1977 | Chensky | 439/160 |
| 5,679,014 A | 10/1997 | Lan-Jen | 439/160 |
| 6,062,883 A | 5/2000 | Schreiber et al. | 439/159 |
| 6,070,924 A | 6/2000 | Sweetman | 294/24 |
| 6,095,849 A | 8/2000 | Stekelenburg | 439/483 |

*Primary Examiner*—Renee Luebke
*Assistant Examiner*—Ann McCamey
(74) *Attorney, Agent, or Firm*—James R. Eley, Esq.; Michael A. Forhan, Esq.; Thompson Hine LLP

(57) ABSTRACT

The present invention provides a device and method for separating electrical connector assemblies. Electrical connector assemblies typically comprise a male connector, commonly called a plug, and a female connector, commonly called a receptacle. The separation of an electrical connector assembly is accomplished by at least one lever disposed in the body of at least one of the connectors. The lever is attached to the body of the connector such that when the lever is "up" the lower portion of the lever is flush with the mating surface so as not to not interfere with the coupling of the connector. Actuation of the lever, i.e., moving the lever to its down position, causes a displacement of at least one of the connectors comprising the electrical connector assembly. The present invention may be adapted to a wide range of electrical connectors including, but not limited to: standard household plug and sockets, parallel connectors, serial connectors, and inline connectors.

27 Claims, 12 Drawing Sheets

EJECTABLE ELECTRICAL CONNECTOR AND METHOD OF USE

This application is a continuation-in-part of application Ser. No. 09/901,248, filed Jul. 9, 2001, and claims the benefit thereof.

TECHNICAL FIELD OF THE INVENTION

The present invention is in the field of electrical connectors. Specifically, the present invention is related to assisted-release electrical connectors.

BACKGROUND

Many electrical devices rely upon electrical cables such as power cords to connect the device to a power source, such as a wall-mounted electrical outlet. Additional electrical cables, such as extension cords, are often required to extend the range of the electrical device from an outlet due to limited outlet availability or because the power cord of the electrical device is too short to reach an available outlet.

An electrical cable typically comprises insulated conductors, such as wire, of a desired length. Typically, one end of the electrical cable terminates in a male connector, while the opposite end terminates in the electrical device or a female connector. Connectors are designed to terminate conductors and cables between electrical circuits within a system, between systems, and between systems and external power sources and signal lines.

A male electrical connector is commonly referred to as a "plug." Female electrical connectors are also commonly called "receptacles," "sockets," "jacks," or "outlets." Examples of plugs in the art include, but are not limited to a flat blade plug as shown in FIG. 1A (along with an electrical outlet), and a flat blade plug with a grounding terminal as shown in FIG. 1B. A male electrical connector, i.e., plug, typically mates with a female connector of the same size and number of conductors.

As shown in FIG. 2, a male electrical connector 200 may comprise a body 202 made from an electrically insulative material. The body 202 has a mating surface 204 from which conductive projections 206 extend. The mating surface 204 can be pressed substantially against a mating surface 304 of a female connector (shown in FIG. 3) so as to place the two connectors in electrical communication. The body 202 of the male connector typically houses the electrical connection (not shown) between the conductors in an electrical cable 208 and the conductive projections 206.

As shown in FIG. 3, a female electrical connector 300 may comprise a body 302 made from an electrically insulative material. The body 302 has a mating surface 304 in which cavities 306 are formed. The cavities 306 contain conductive receivers 308 adapted to accept the insertion of conductive projections 206 (shown in FIG. 2). The body 302 of the female electrical connector 300 typically encapsulates the connection (not shown) between the conductors within an electrical cable 310 and the conductive receivers 308.

Typically, a plug is held in a receptacle after insertion due to a friction fit between the conductive projections of the male connector and the corresponding conductive receivers of the female connector. The friction fit is due to the insertion force required to overcome the interaction of the conductive projections of the male connector with the conductive receivers of the female connector when coupling the connectors, and is a desirable characteristic in order to achieve and maintain a good electrical connection.

A male connector coupled with a female connector is referred to as a "connector assembly." A connector assembly can typically be uncoupled by applying sufficient force to pull the male and female connectors apart. However, the amount of force required to uncouple the connectors can often be excessive for a number of reasons, creating difficulty in separating the connectors. Connector assemblies can also be difficult to uncouple if the connector assembly is located in a partially obstructed or difficult-to-reach area such as behind furniture. Another factor that can make connector assemblies more difficult to uncouple is the addition of more conductors, such as a grounding terminal, which increases the friction fit between the male and female connectors and changes the overall dynamics of the uncoupling process. A partially separated connector assembly is an undesired condition, as it exposes the conductive projections of the male connector, creating a shock hazard. In addition, another conductive material could contact the exposed projections and cause a short circuit or fire.

Prior attempts have been made to solve this problem. For example, Schlums U.S. Pat. No. 2,051,425 teaches an electric plug having a cammed means for detaching the plug from a receptacle. The detaching means comprises a cam having an outer arm portion and an actuator portion. To uncouple the plug from the socket, the outer arm portion of the cam is depressed, causing the actuator portion to apply an oblique force against the mating surface of the receptacle, urging the plug from the receptacle due to the curvature of the actuator portion. The amount of mechanical advantage employed by the cam decreases as the outer arm portion of the cam is moved toward the plug's housing. The stated purpose for this configuration is to match the mechanical advantage of the cam to the detaching force required, the rationale being that a greater amount of force is required to initiate separation of the plug and receptacle when the surface area contact between the male and female connectors is the greatest. The amount of force required decreases as the plug and receptacle separate.

The movement of a representative cam as disclosed by Schlums is depicted in FIG. 4. As an outer arm portion 402 of a cam 400 is pressed downward, the cam 400 rotates about a fulcrum 404. As the cam 400 rotates, an actuator portion 406 extends laterally to apply force against a mating surface 408 of a receptacle. As can be seen, the amount of lateral movement exhibited by the actuator portion 406 as the cam is rotated from position a1 to positions a2 and a3 is limited due to the curvature of the actuator portion 406, which is necessary to effect a varying mechanical advantage. Thus, to achieve the amount of cam actuator movement necessary to ensure separation of the plug and receptacle the cam as taught by Schlums would require a larger connector housing than is practical for modern power connectors.

An alternate embodiment of the electric plug as taught by Schlums features a single cam of the type generally depicted in FIG. 5 situated between the conducting projections of a male connector. The actuator portion 406' of this cam 400' is shaped with less curvature than the cam shown in FIG. 4 such that the actuator portion 406' has little variation in mechanical advantage. In this configuration, a smaller contacting portion 510 of the actuator portion 406' comes into contact with the mating surface 408' of a receptacle. Although the cam 400' exhibits greater lateral movement than the cam shown in FIG. 4, the amount of lateral movement is still less than necessary to ensure complete disengagement of the connector assembly.

The cams shown in FIGS. 4 and 5 both suffer from limited lateral movement of the actuator portion 406, 406', which can result in incomplete disengagement of the plug and receptacle. In addition, the amount of lateral movement provided by the actuator portion 406, 406' is not proportional to the movement of the outer arm 402, 402'. As a result, the plug begins separating from the receptacle at a slow rate as the cam 400, 400' moves from position a1 to position a2, and accelerates as the connector disengagement cycle continues to position a3. The partially exposed conductive projections of the plug create a risk of arcing between conductors, short circuits, and electrical shock. Thus, it is desirable not only to ensure complete disengagement of the plug and receptacle, but also to minimize the time required to disengage the plug from the receptacle.

A further limitation of the device disclosed by Schlums is that a suitably sized actuator portion would likely interfere with a third conductor, such as the grounding terminal commonly found on modern power cords. Reducing the size of the actuator portion of the cam to eliminate such interference would only further serve to exacerbate the aforementioned limitations on lateral movement of the actuator portion of the cam, hindering full disengagement of the plug and receptacle. The grounding terminal also increases the amount of friction between the connectors. In addition, the grounding terminal extends farther than the conductive projections carrying electrical power. This is intended for safety purposes, to keep the equipment attached to the connector in a grounded state before the conductive projections carrying power are engaged and after they are disengaged. Thus, friction between mating connectors is present for a greater disengagement distance, which can cause problems for cam actuators due to their limited lateral movement and decreasing mechanical advantage during the disengagement cycle. As a result, more force must be exerted on the cam actuator to overcome the additional friction due to the grounding terminal. Moreover, the connectors may not be completely separated due to the limited lateral travel of the cam actuator.

Accordingly, a need exists to provide an electrical connector that can easily and conveniently be decoupled from its mating connector with minimal force. There is also a need for an electrical connector that can be easily separated from its mated connector when the electrical connector assembly is located in an obstructed or difficult-to-reach area. Yet another need exists to ensure rapid and complete separation of coupled electrical connector assemblies.

SUMMARY OF THE INVENTION

Preferred embodiments of the present invention satisfy the above-enumerated needs. In addition, it will be appreciated that similar advantages may be obtained in other applications of the present invention. Such advantages may become apparent from the present disclosure or through practice of the present invention.

The present invention provides an improved electrical connector as well as a method for separating coupled connectors in an electrical connector assembly. The ejectable electrical connector may be a male connector, a female connector, or any other similar, suitable, or conventional type of connector. An example of a male ejectable electrical connector is a plug, and examples of female ejectable electrical connectors include jacks, sockets, receptacles, and wall outlets. The ejectable electrical connector according to one embodiment of the invention includes a lever that is pivotally connected to the body. The lever includes an actuator portion shaped to maximize lateral movement in order to effect a substantially full detachment of the coupled connector assembly components when actuated. In addition, the lever is shaped to disengage the connectors more quickly than the prior art, thus minimizing the risk of electrical shocks, arcing, and short circuits. Gripping force may be applied to both an upper portion of the lever and the bottom surface of the connector, thereby causing the lower, opposing portion of the lever to rapidly extend from the mating surface of the ejectable electrical connector. The lever may be pivotally attached to the body of the connector in such a way as to not interfere with the connection between mating connectors during engagement. The ejectable electrical connector may be a part of an electrical connector assembly. Electrical connector assemblies may comprise a male connector, e.g., a plug, that is engaged with a female connector, e.g., a receptacle such as a wall outlet. In the present invention, the decoupling of an electrical connector assembly is accomplished by manual actuation of at least one lever that is pivotally connected to the body of at least one of the connectors.

The limitations of the prior art cam are overcome with a "type 1" lever. A type 1 lever is defined by physics convention as a lever wherein the fulcrum is situated between the applied force and the load. A type 1 lever provides a constant mechanical advantage, the amount of the mechanical advantage depending on the position of the fulcrum in relation to the applied force and the load. The mechanical advantage of a type 1 lever increases as the fulcrum is moved farther away from the applied force and closer to the load. This constant mechanical advantage provides more separation force throughout the connector assembly separation process, a desirable characteristic for particularly stubborn connector assemblies or connectors having greater numbers of conductors and thus a higher friction fit.

In addition, a type 1 lever can provide greater actuator displacement than the prior art cam, ensuring complete separation of the plug and receptacle. The type 1 lever, unlike a cam, may be accommodated by the smaller housing seen in modern connectors without compromise to the lever's travel effectiveness. A type 1 lever may also be fitted to three-conductor grounded plugs without interfering with the grounding terminal or limiting the movement of the actuator portion of the lever.

The direction of movement of the lower portion of a type 1 lever differs from the actuator portion of a cam, in that a cam exhibits a sliding action against the mating surface of the opposing connector, whereas the lower portion of a type 1 lever applies the disengaging force directly against a focused area of the mating surface of the opposing connector. This results in a faster disengagement of the connector assembly for a corresponding movement of the lever, reducing the risk of arcing, electrical shocks, and short circuits.

Although a type 1 lever is the preferred embodiment for the present invention, it should be noted that other levers, such as type 2 and type 3 levers, may also be utilized.

The present invention is not limited to any specific type or use of electrical connector. In fact, the levered ejector disclosed herein is not limited to electrical-type connectors. One preferred embodiment of the present invention is particularly useful with two-conductor or three-conductor, male or female electrical connectors, e.g., with electrical cables, extension cords, or other similar, suitable, or conventional electrical cables. Nevertheless, the present invention may be implemented with any of the connectors described above in the background as well as other similar, suitable, or conventional connectors that are now known or may be later developed. Examples of other connectors to which the present invention may be applied include, but should not be limited to, serial data connectors, parallel data connectors, and in-line connectors. The connectors may be used for any suitable purpose such as for electrical power distribution (e.g., with power strips, wall outlets, power cords, extension cords, and other similar, suitable, or conventional power distribution systems), data transmission, control signal transmission, response signal transmission, timing signal transmission, and other similar, suitable, or conventional uses that are now known or may be later developed. In addition, it should be recognized that the present invention may be used to separate connector/wall outlet assemblies as well as any other similar, suitable, or conventional type of electrical connector assembly. The present invention may also be utilized in non-electrical connectors, such as mechanical couplings in which components are coupled together through the use of friction between the mating surfaces. Such coupled mechanical connections may be purely mechanical or otherwise used to convey some medium from one connector to the other.

In addition to the novel features and advantages mentioned above, other objects and advantages of the present invention will be readily apparent from the following descriptions of the drawings and exemplary embodiments.

DESCRIPTION OF THE PREFERRED EMBODIMENTS

In accordance with the foregoing summary, the following presents a detailed description of what is considered the preferred embodiments of the invention.

Figure 6A:
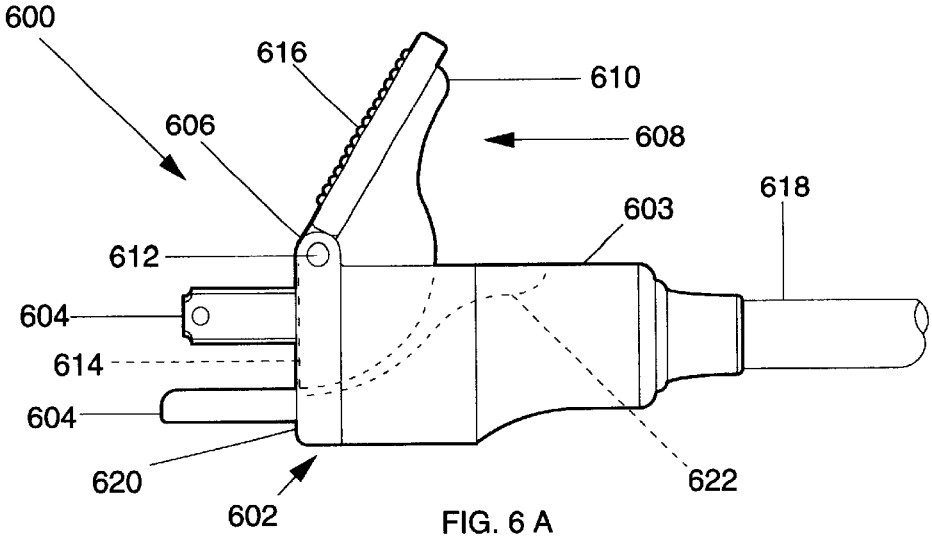
FIGS. 6A, 6B, and 6C are side elevation views of a male ejectable electrical connector showing progressive stages of actuation in accordance with one embodiment of the present invention.
Figure 6B:
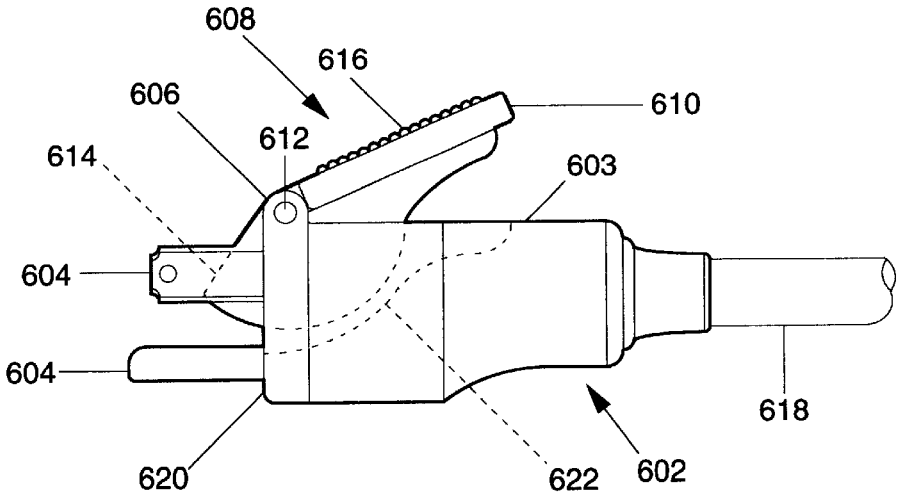
Figure 6C:
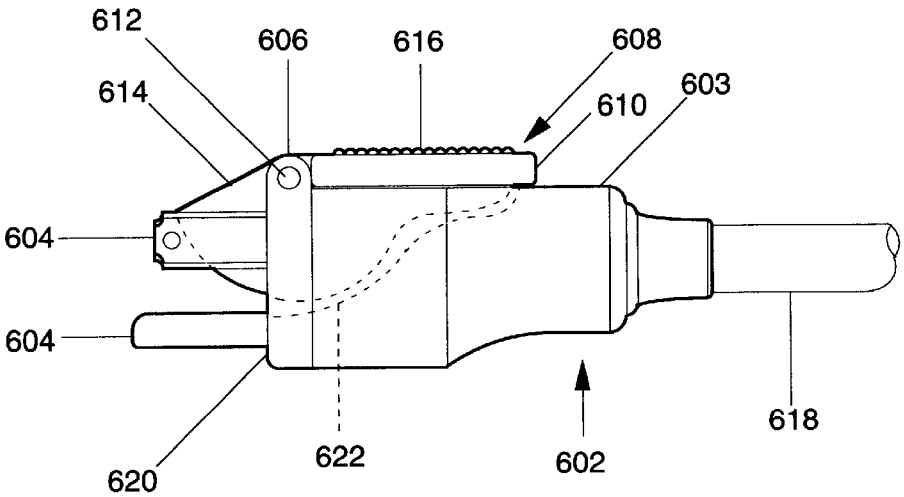

FIGS. 6A, 6B and 6C show side views of a male ejectable electrical connector 600 of the present invention. This embodiment of the male ejectable electrical connector 600 comprises a body 602 having a side surface 603 and a mating surface 620, conductive projections 604, a lever attachment means 606, and a lever 608 that is pivotally or rotatably connected to the body 602. Internal wiring connections between the conductive projections 604 and the conductors within a cable 618 have not been shown for the sake of clarity. In this example, the lever 608 is mounted at least partially in a channel 622 of the body 602. However, in other embodiments, the lever 608 may be located along an outside portion of the body 602. The lever 608 may be comprised of an upper portion 610, an engagement means 612, and a lower portion 614. The lever 608 is pivotally or rotatably connected to the body 602. Any suitable combination of attachment means 606 and engagement means 612 may be used to pivotally or rotatably connect the lever 600 to the body 602. Examples of suitable attachment means 606 include, but are not limited to, female connecting portions, male connecting portions, posts, holes, apertures, receptacles, rods, axles, pins, chains, sprockets, belts, pulleys, balls, sockets, hinges, trunnions, and clips. Similarly, examples of suitable engagement means 612 include, but are not limited to, female connecting portions, male connecting portions, posts, holes, apertures, receptacles, rods, axles, pins, chains, sprockets, belts, pulleys, balls, sockets, hinges, trunnions, and clips. In this particular example, posts 612 are adapted to rotate in respective apertures 606. As a result, the attachment means 606 and engagement means 612 cooperate in order to permit the lever 608 to pivot or rotate in relation to the body 602.

The lever 608 may have three main portions: an upper portion 610, an engagement means 612, and a lower portion 614. The upper portion 610 is that portion of the lever 608 upon which a user may apply a force to the lever. The engagement means 612 of the lever interacts with the attachment means 606 of the body to form the fulcrum and pivotally connect the lever 608 to the body 602 of the male ejectable electrical connector 600. The lower portion 614 of the lever 608 may reside at least partially in the channel 622 of the body 602 when the lever is an up or closed position. When the lever 608 is moved to a down or open position, the lower portion 614 of the lever contacts the female electrical connector, preferably the mating surface, to urge the male ejectable electrical connector away from the female electrical connector of the connector assembly. The lever is configured such that the fulcrum point does not change as the lever is rotated through its range of motion. The amount of mechanical advantage is thus also fixed, making the lever more capable than cam actuators for ejecting connectors with additional conductors such as grounding terminals. More importantly, the amount of movement of the actuator portion of the lever is much greater than the cam taught by the prior art, ensuring rapid and full disengagement of the plug and receptacle.

The upper portion 610 of the lever 608 is where a person may exert a force to separate the male ejectable electrical connector 600 from a receptacle of an electrical connector assembly. Although not required, the force may be applied by gripping the upper portion 610 and the bottom of the body 602 between the thumb and a portion of the index finger, and applying pressure. It is preferred that the upper portion 610 of the lever 608 comprises a finger pad portion 616 for the comfortable placement of a human finger to exert a force upon. The finger pad may have a textured and/or contoured surface to ensure good contact between the finger pad and the user's fingers, as well as to provide positive tactile feedback to the user.

Figure 7:
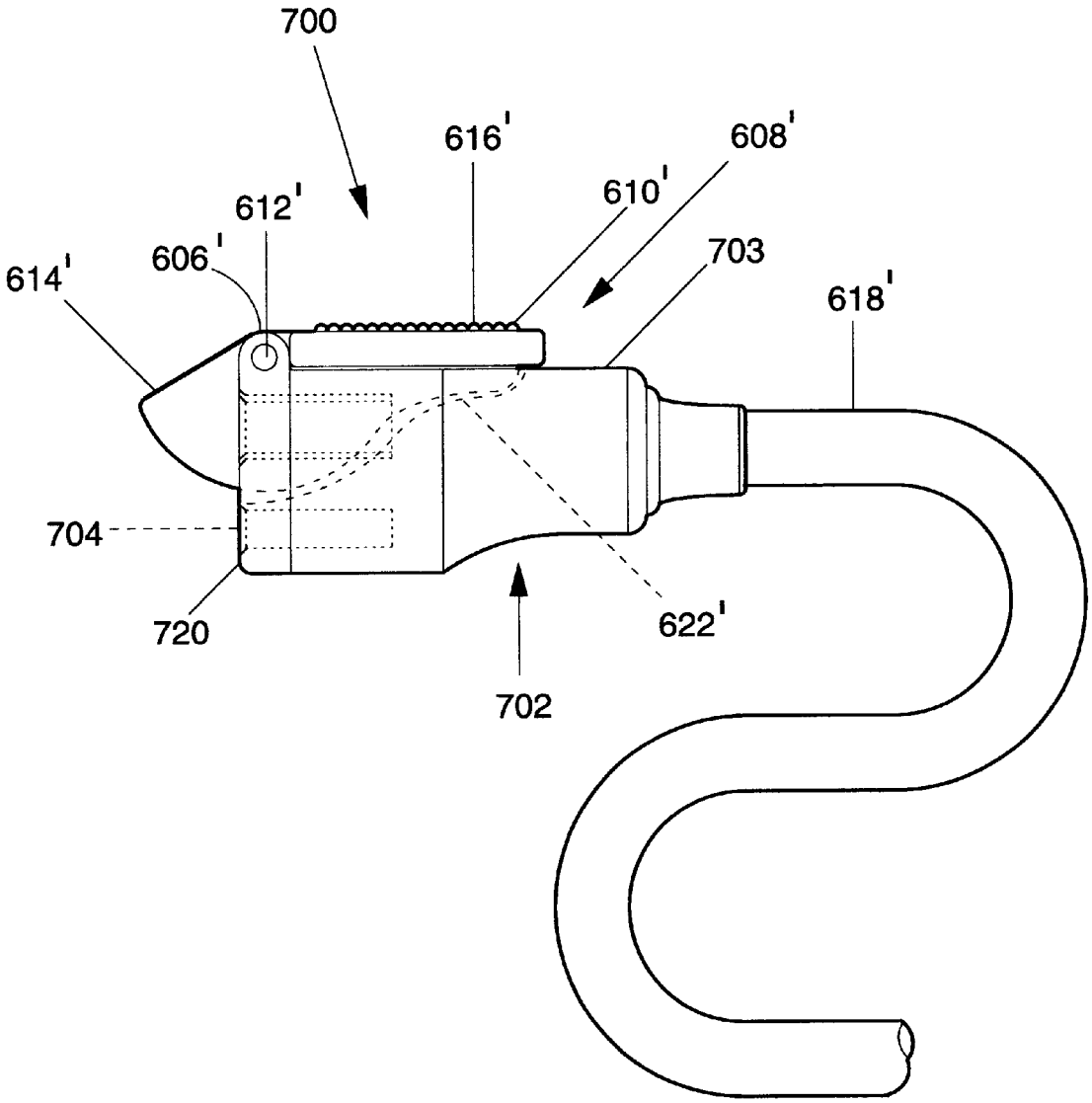
FIG. 7 is a side elevation view of a female ejectable electrical connector shown in its fully actuated state in accordance with one embodiment of the present invention.

FIG. 7 shows a side view of a female ejectable electrical connector 700 of the present invention. The female ejectable electrical connector 700 may include any of the optional or preferred features of the male ejectable electrical connector 600. The female ejectable connector 700 comprises a body 702 having a side surface 703 and a mating surface 720, conductive receivers 704, an attachment means 606', and a lever 608' that is connected to the body 702. Internal wiring connections between the conductive receivers 704 and the conductors of a cable 618' have not been shown for the sake of clarity. The lever 608' may be comprised of an upper portion 610', an engagement means 612' and a lower portion 614'. In this example, the lever 608' is mounted at least partially in a channel 622 of the body 702. However, in other embodiments, the lever 608' may be located along an outside portion of the body 702. The lever 608' is pivotally or rotatably connected to the body 702. Any suitable combination of attachment means 606' and engagement means 612' may be used to pivotally or rotatably connect the lever 608' to the body 702. Examples of suitable attachment means 606' include, but are not limited to, female connecting portions, male connecting portions, posts, holes, receptacles, apertures, rods, axles, pins, chains, sprockets, belts, pulleys, balls, sockets, hinges, trunnions, and clips. Similarly, examples of suitable engagement means 612' include, but are not limited to, female connecting portions, male connecting portions, posts, holes, apertures, receptacles, rods, axles, pins, chains, sprockets, belts, pulleys, balls, sockets, hinges, trunnions, and clips. In this particular example, posts 612' are adapted to rotate in respective apertures 606'. As a result, the attachment means 606' and engagement means 612' cooperate in order to permit the lever 608' to pivot or rotate in relation to the body 702.

A person may actuate the ejector by applying a downward force on the upper portion 610' of the lever 608' to separate the female ejectable electrical connector 700 from a male electrical connector of an electrical connector assembly. It is preferred that the upper portion 610' of the lever 608' comprises a finger pad portion 616' for the comfortable placement of a human finger to exert a force upon. The finger pad may have a textured and/or contoured surface to ensure good contact between the finger pad and the user's fingers, as well as to provide positive tactile feedback to the user.

Figure 8:
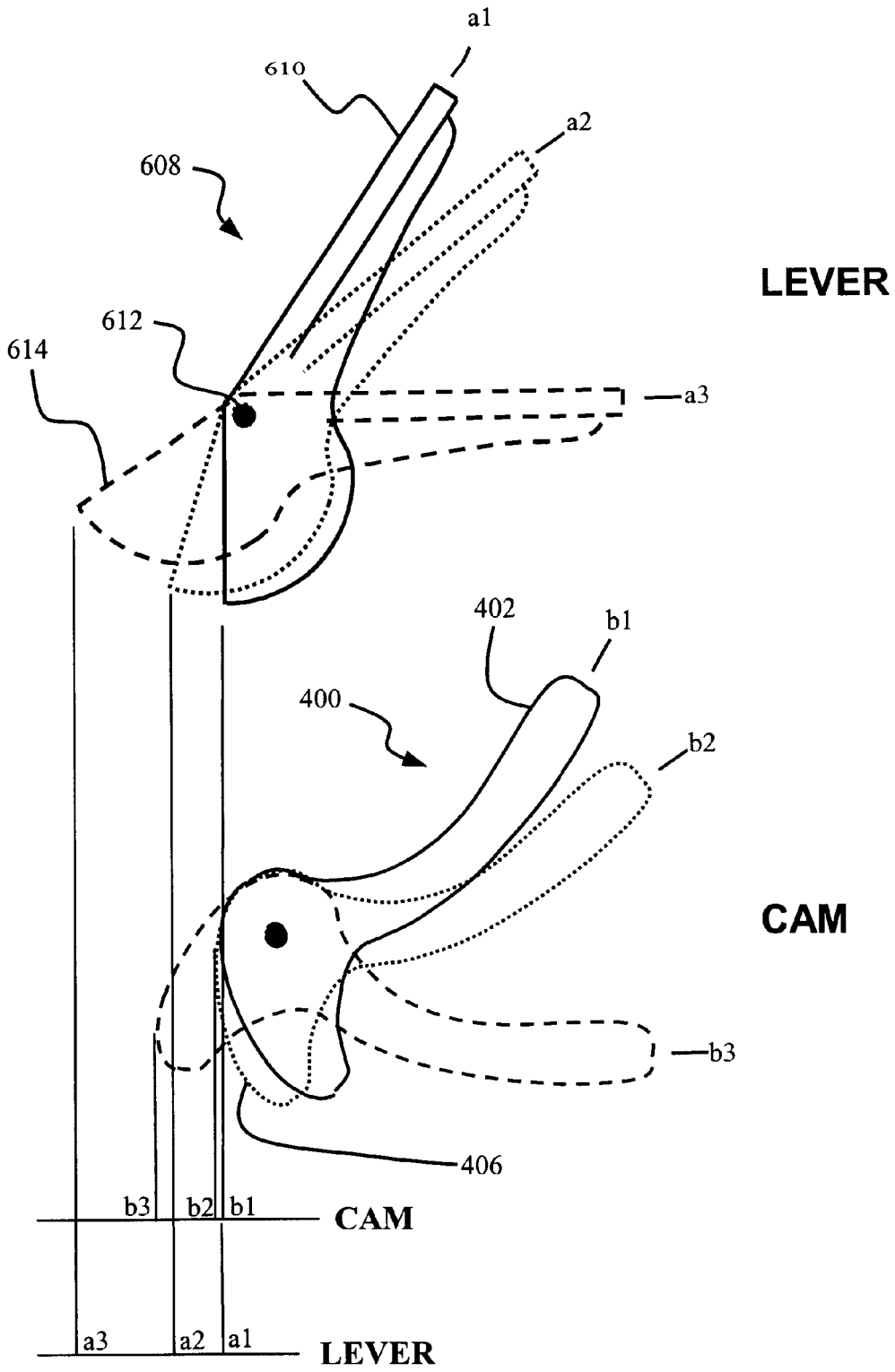
FIG. 8 is a diagram comparing lateral movement of the actuator portion of a cammed connector in accordance with the prior art in comparison to the corresponding lateral movement of the lower portion of a levered connector according to an embodiment of the present invention.
Figure 9:
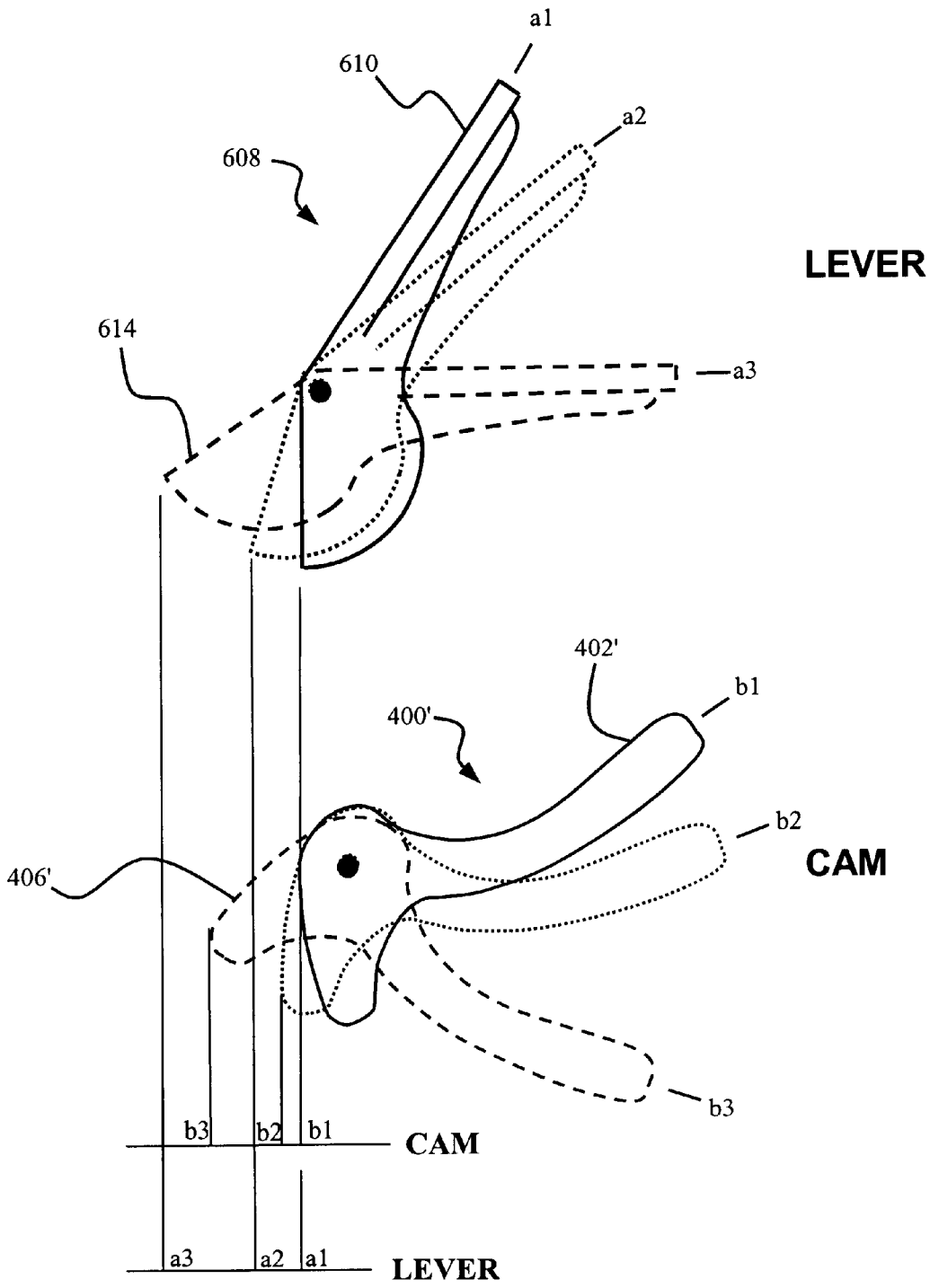
FIG. 9 is a diagram comparing lateral movement of the actuator portion of an alternate embodiment of a cammed connector in accordance with the prior art in comparison to the corresponding lateral movement of the lower portion of a levered connector according to an embodiment of the present invention.

Referring now to FIGS. 8 and 9, the lever 608 of the present invention is shown to provide greater lateral movement than the cams 400, 400' of the previously discussed prior art. In addition, the lower portion 614 of the lever moves laterally at a faster rate than the actuator portion 406, 406' of the prior art. This is due to the lower portion 614 of the lever moving laterally in direct proportion to movement of the upper portion 610, providing faster disengagement of the connector assembly and thereby decreasing the risk of electrical shocks, arcing, and short circuits. This is depicted graphically in FIGS. 8 and 9 by comparing the movement of the actuator portion 406, 406' of embodiments of the prior art and the lower portion 614 of the lever 608 in accordance with the present invention as the lever is rotated from position a1 to positions a2 and a3 and the cam 400, 400' is rotated from position b1 to positions b2 and b3. It may also be seen that the upper portion 610 of the lever 608 requires less angular displacement for a given movement of the lower portion 614, in comparison to the movement of the outer arm portion 402, 402' and actuator portion 406, 406' of the cam 400, 400', making the lever 608 compatible with smaller electrical connector bodies.

The present invention may also be implemented in connectors that have a combination of male and female conductive portions. Additionally, one or each connector of an electrical connector assembly may be an ejectable electrical connector of the present invention. The following examples will discuss the present invention in further detail.

EXAMPLE ONE

Only Male Connector Having an Ejection Lever

Figure 10:
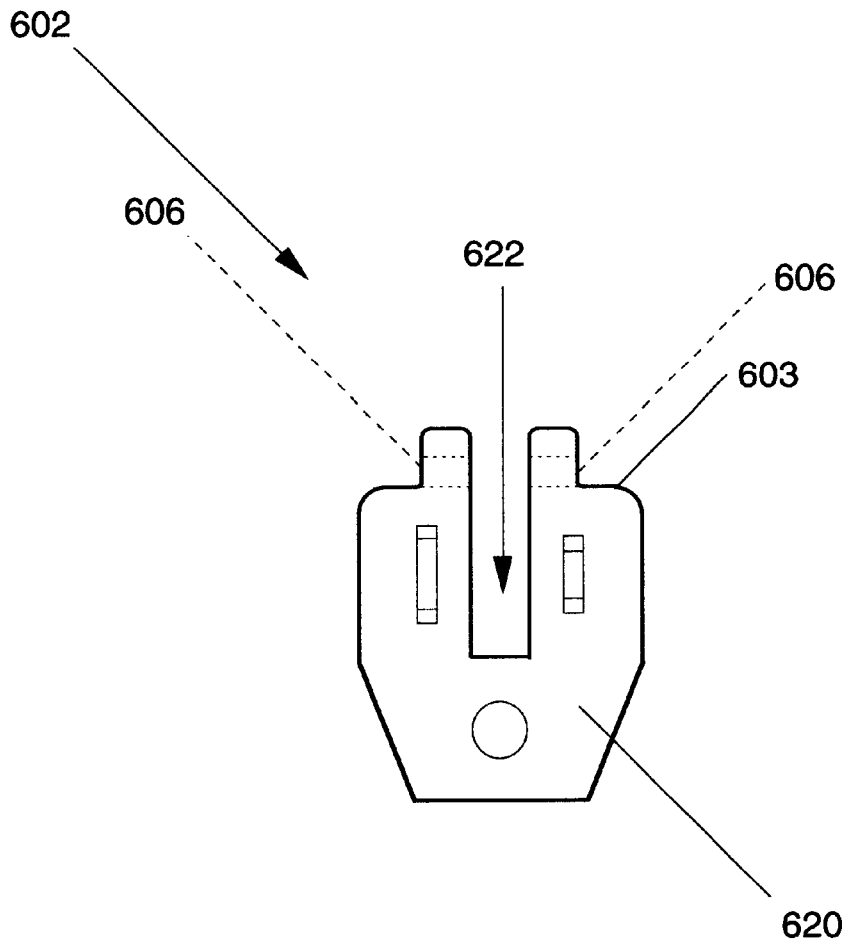
FIG. 10 is a side elevation view of the mating surface of a male ejectable electrical connector body in accordance with one embodiment of the present invention.

In this embodiment, the disengagement of the male ejectable electrical connector from the female electrical connector is accomplished by a lever mounted to the male ejectable electrical connector. FIG. 10 shows the body 602 of a male ejectable electrical connector of the present invention which has a channel 622 extending from a side surface 603 to the mating surface 620. The lever 608 is not shown in order to more clearly show the channel 622. The channel 622 may have any suitable shape to allow the lever to rotate or pivot from an up or closed position to a down or open position. Any suitable portion of the body 602 may form attachment means 606. In this example, the attachment means 606 is formed at an edge of the side surface 603 and the mating surface 620. The attachment means 606 interacts with engagement means on the lever (not shown) to connect the lever to the body 602 of the male connector. As noted above, the attachment means may be a post or any other suitable attachment device adapted to engage the engagement means of the lever to pivotally connect the lever to the body 602. The attachment means 606 and the engagement means of the lever act together to form the fulcrum point of the lever.

Figure 11A:
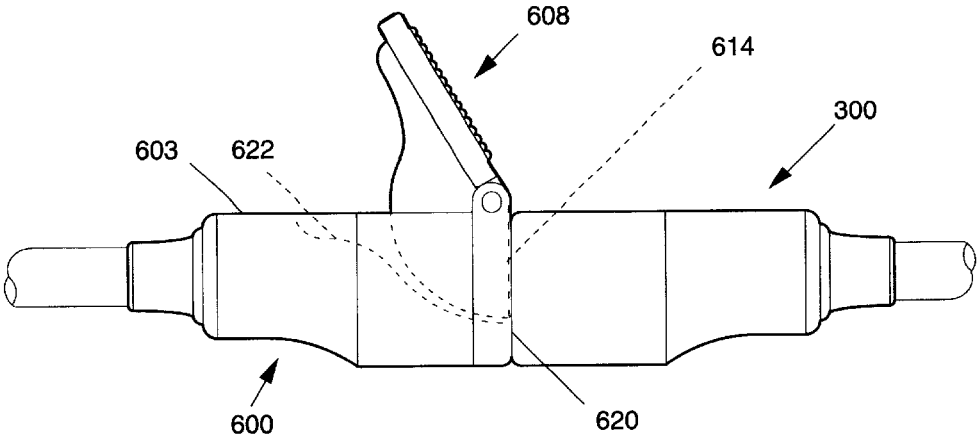
FIGS. 11A, 11B, and 11C are side elevation views of a male ejectable electrical connector coupled to a mating female electrical connector in progressive stages of disengagement, in accordance with one embodiment of the present invention.
Figure 11B:
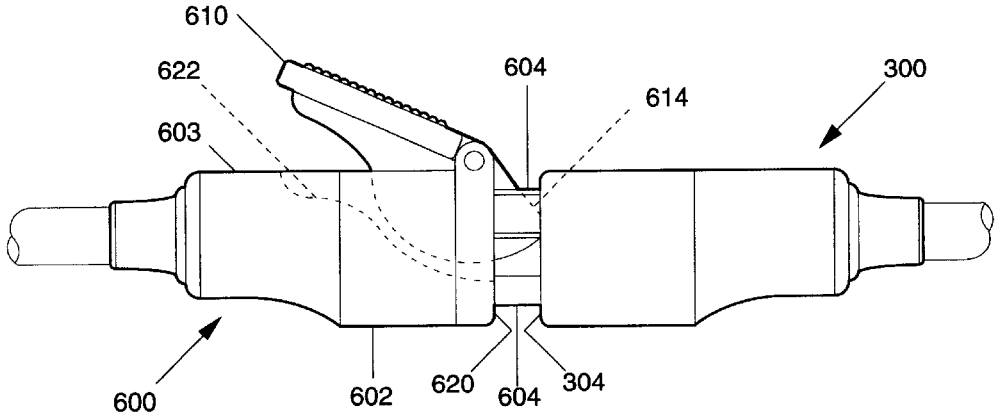
Figure 11C:
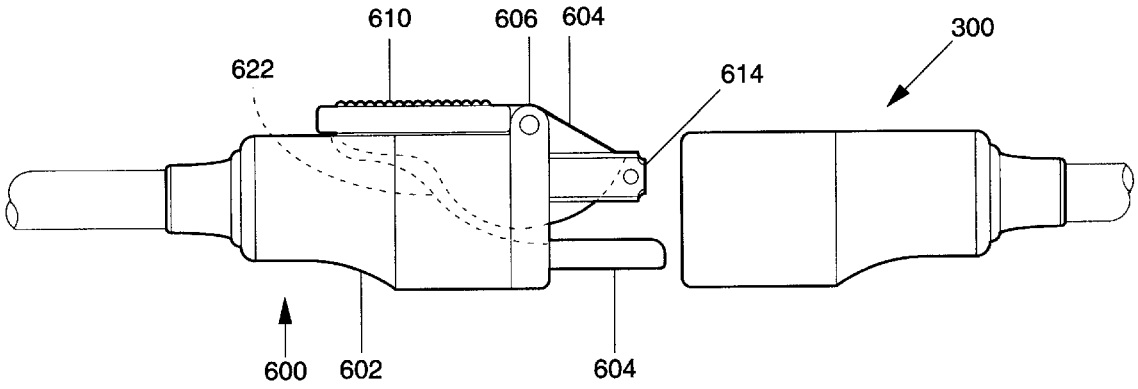

When the lever 608 of a male ejectable connector 600 is in the up position as seen in FIG. 11A, the lower portion 614 of the lever 608 may be substantially enclosed by the channel 622 and substantially flush with the mating surface 620 of the connector. However, in alternative embodiments, the lower portion 614 of the lever 608 may protrude from, or be recessed from, the mating surface 620. As the lever 608 is moved towards its down position, the upper portion 610 of the lever 608 moves towards the body 602 of the connector 600 while the lower portion 614 simultaneously moves outward from the mating surface 620, as in FIG. 11B. The lower portion 614 contacts the mating surface 304 of the female electrical connector 300 and urges the female electrical connector 300 away from the male ejectable electrical connector 600. As shown in FIG. 11C, upon reaching the down position, the upper portion 610 of the lever 608 rests against the body 602 of the connector 600 and the lower portion 614 of the lever 608 is fully extended. Furthermore, the male ejectable electrical connector 600 and the female electrical connector 300 are fully disengaged.

EXAMPLE TWO

Only Female Connector Having an Lever

Figure 1A:
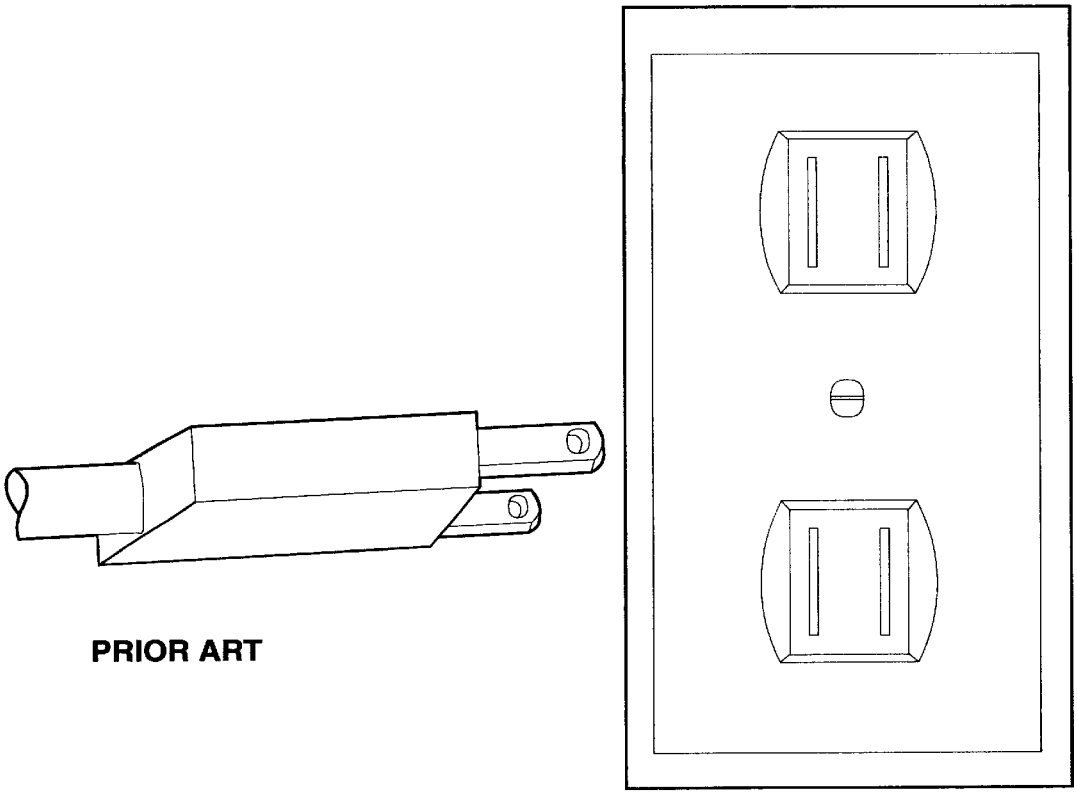
FIGS. 1A and 1B are perspective views of a flat blade plug and receptacle and a perspective view of a flat blade plug with round grounding terminal according to the prior art.
Figure 1B:
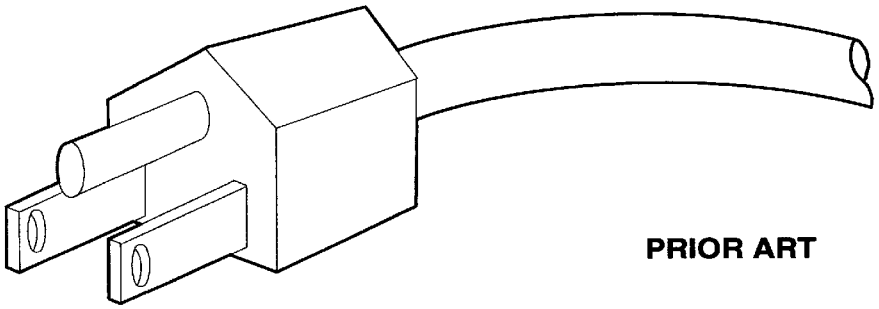
Figure 2:
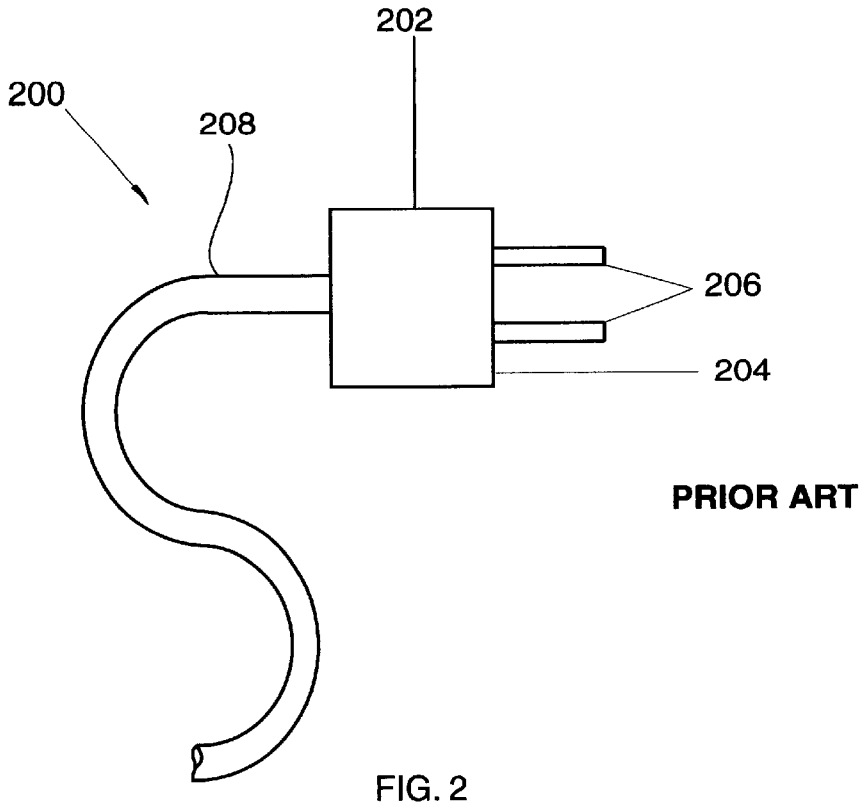
FIG. 2 is a side elevation view of a male electrical connector according to the prior art.
Figure 3:
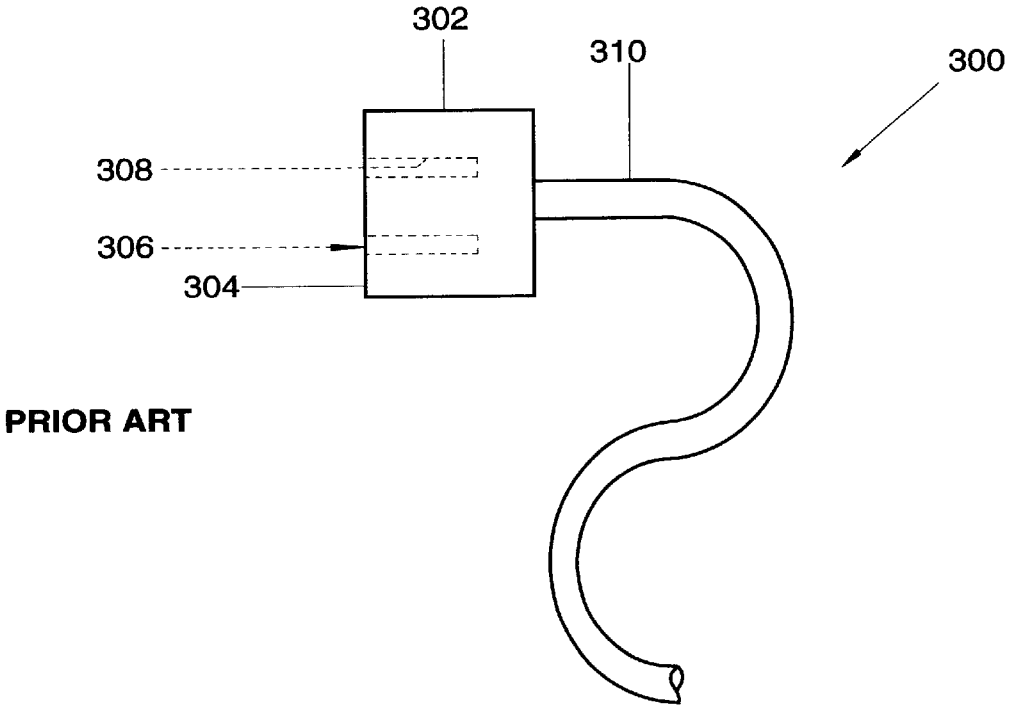
FIG. 3 is a side elevation view of a female electrical connector according to the prior art.
Figure 4:
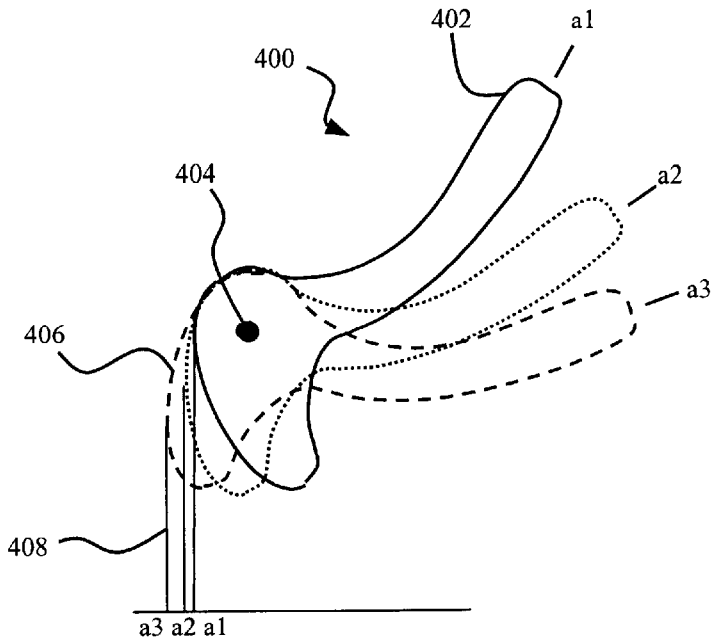
PRIOR ART Fig. 4
FIG. 4 is a diagram showing the lateral movement of a cam portion of an electrical connector according to the prior art.
Figure 5:
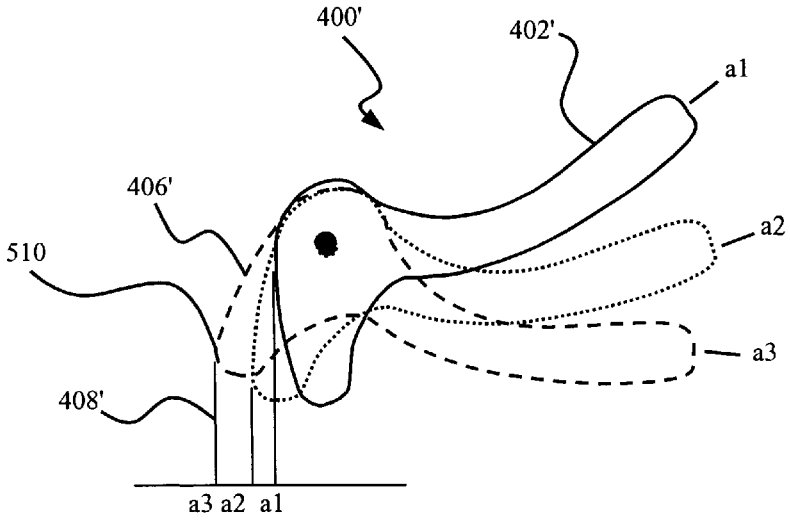
PRIOR ART Fig. 5
FIG. 5 is a diagram showing the lateral movement of a cam portion of an alternate embodiment of an electrical connector according to the prior art.

With reference to FIGS. 2 and 7, in this embodiment the disengagement of the female ejectable electrical connector 700 from the male electrical connector 200 is accomplished by a lever 608'. The rotation of the lever 608' about a fulcrum formed by an attachment means 606' and an engagement means 612' causes the lower portion 614' of the lever to contact the mating surface 204 of the male electrical connector 200. As the lever 608' is moved to its down position, the conductive projections 206 of the male electrical connector 200 are urged from the conductive receivers 704 of the female ejectable electrical connector 700. This embodiment may include any of the optional or preferred features of the previous embodiments.

EXAMPLE THREE

Both Male and Female Connectors Having Levers

With reference to FIGS. 6 and 7, in this embodiment the disengagement of a male ejectable electrical connector 600 from a female ejectable electrical connector is accomplished by a lever 608 disposed in male ejectable electrical connector 600, and by a lever 608' disposed in a female ejectable electrical connector 700. The male ejectable electrical connector and the female ejectable electrical connector may include any of the optional or preferred features of the above described embodiments. In order to separate the connectors 600, 700, either or both of the levers 608, 608' of the connectors may be actuated. The lower portions 614, 614' of the levers 608, 608' may be offset or aligned in relation to each other. Consequently, when the levers are moved to their down positions, the lower portions 614, 614' of the levers may abut each other or the opposing mating surfaces 620, 720 to push apart the connectors.

EXAMPLE 4

Figure 12A:
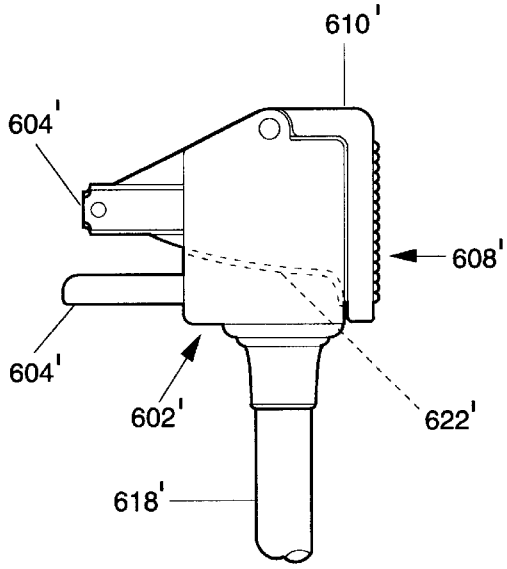
FIGS. 12A and 12B are side elevation views of a male ejectable electrical connector with its lever in both fully actuated and fully unactuated positions, in accordance with another embodiment of the present invention.
Figure 12B:
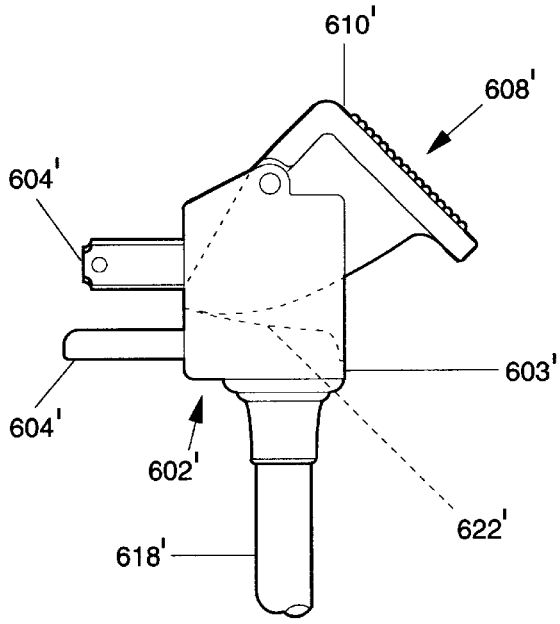

Connector Having a Cable Disposed at an Angle Relative to the Male or Female Conductive Portions The lever of the present invention may have any shape which is suitable for the particular application. FIGS. 12A and 12B show one example of an alternative shape of a lever of the present invention. In this example, a cable 618' terminates in a connector body 602'. Male conductive projections 604' extend from the connector body 602' at an angle relative to the cable 618'. In this particular example, the angle is about 90 degrees. Nevertheless, it should be recognized that the relationship between the cable 618' and the conductive projections 604' may be any angle greater or less than 90 degrees. A lever 608' is pivotally or rotatably mounted to the connector body 602'. The lever 608' may include any of the optional or preferred features of the levers described above. The lever 608' of this example is mounted in a channel 622' and has a curved or contoured upper portion 610'. The degree of curvature of the upper portion 610' may be any amount. In this example, the upper portion 610' has about a 90 degree curve such that the upper portion 610' substantially rests against the side surface 603' of the connector body 602' when the lever 608' is in a down position. Such an embodiment may be useful to limit the amount of space used by the present invention. This embodiment of the present invention may also be implemented in connectors having female conductive receivers.

EXAMPLE 5

Lever Biased in an Up Position

The lever of the present invention may be biased in an up position, providing benefits not recognized in the prior art, such as Schlums U.S. Pat. No. 2,051,425. Schlums teaches away from an upward-biasing means, instead disclosing a means for biasing the outer arms of one or more cams in a downward direction to keep the outer arms stowed against the connector housing until the plug is mated with a receptacle. This is intended to reduce the risk of damage to the outer arms during handling of the plug. In contrast, the present invention utilizes a type 1 lever wherein the upper portion of the lever is biased in an upward direction, causing the lower portion of the lever to remain flush with the mating surface of the connector. This eliminates the additional effort required in the prior art to overcome the force of the biasing means in addition to the frictional force that must be overcome to engage the connectors. A further benefit of upward-biasing the upper portion of the lever is that the upper portion is held away from the body of the connector so as to not interfere with engagement of the connector, which can happen in the prior art if the outer arm of the cam is obstructed when attempting to engage the connector.

Figure 13A:
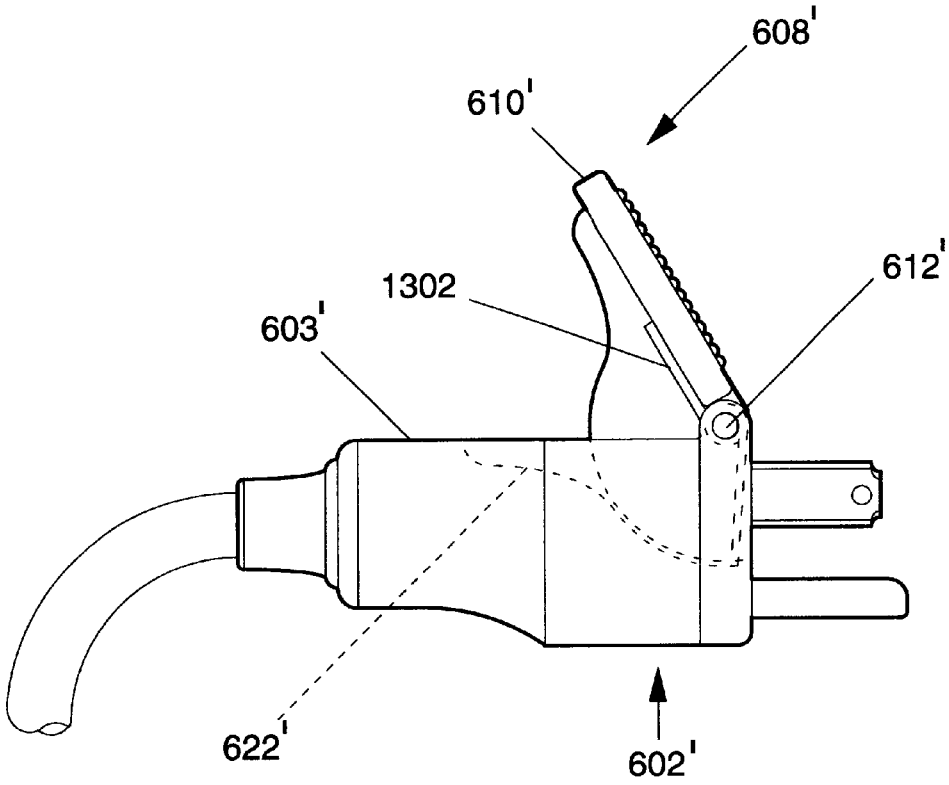
FIGS. 13A and 13B are side elevation views of a lever of an ejectable electrical connector equipped with a biasing device, in accordance with yet another embodiment of the present invention.
Figure 13B:
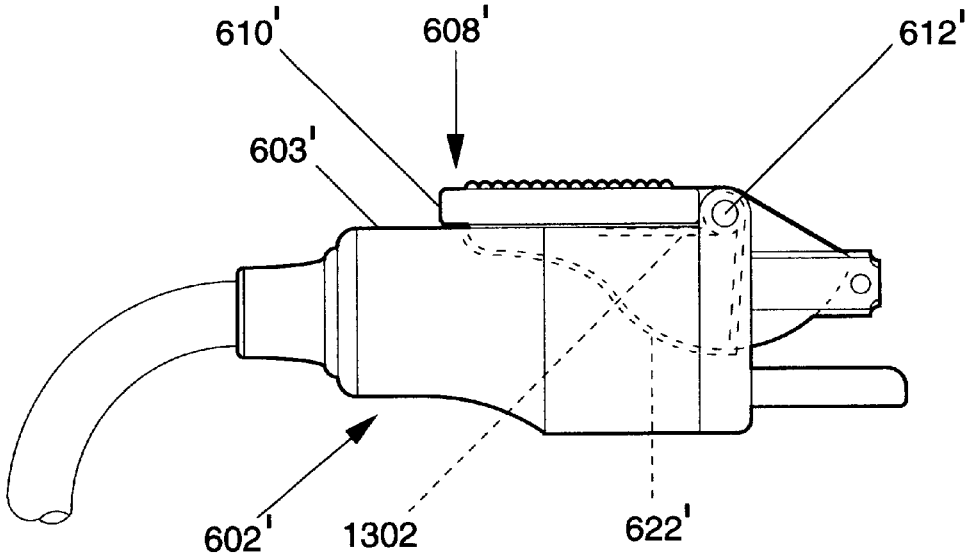

In the example shown in FIGS. 13A and 13B, the lever 608' is biased in an up position by a biasing means 1302 or any other similar, suitable, or conventional device that may be biased in a certain direction or position. Examples of biasing means 1302 include, but are not limited to, a torsion spring, a compression spring, an extension spring, a leaf spring, or any other similar, suitable, or conventional type of spring. Further, the biasing means may be constructed of any suitable material, such as metal, plastic, and composites.

The biasing means 1302 may be connected to the connector body 602' in any suitable manner. In this example, the biasing means 1302 is located in the channel 622' of the body 602' and connected to the engagement means 612' of the lever 608'. In other embodiments, the biasing means 1302 may be connected to the attachment means (not shown) of the body 602'. In addition, it should be recognized that the biasing means 1302 may be located outside of the channel 622' in alternative embodiments.

The biasing means 1302 may be connected to any portion of the lever 608' in order to bias the lever 608' in the desired direction. As shown in the example of FIGS. 13A and 13B, the biasing means 1302 may rest against an upper portion 610' of the lever 608'. Biasing the lever 608' in an up position may be useful to keep the lever 608' out of the way when engaging two connectors together. The biasing means 1302 may have any tension which is suitable for the intended purpose. In order to disconnect two connectors, the lever 608' may be moved to a down position as shown in FIG. 13B.

Figure 14A:
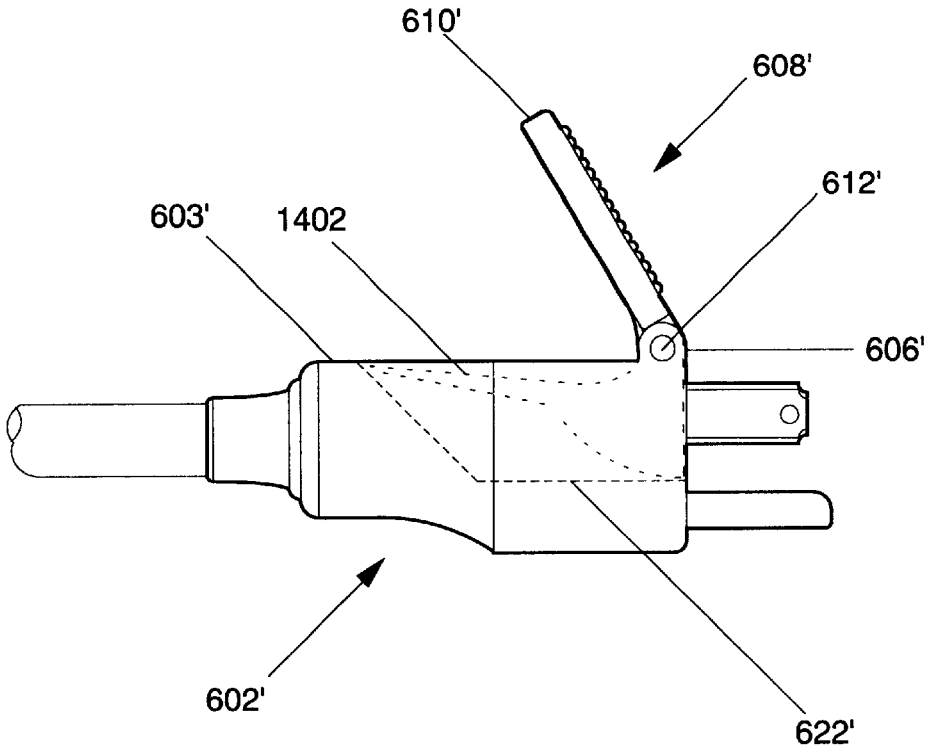
FIGS. 14A and 14B are side elevation views of a lever of an ejectable electrical connector equipped with a monolithic biasing device in accordance with still another embodiment of the present invention.
Figure 14B:
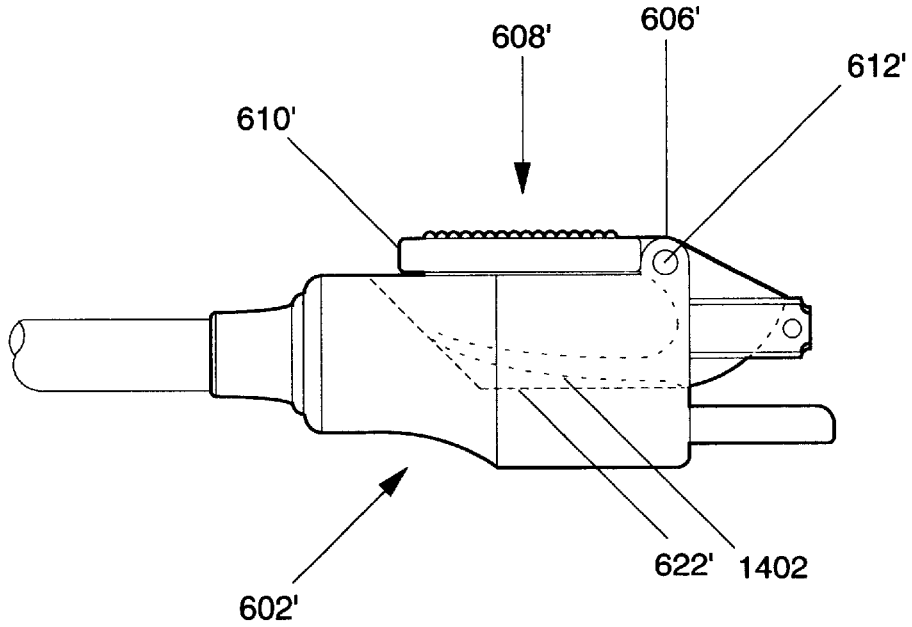

The biasing means may also be formed as an integral, monolithic portion of the lever to reduce manufacturing and assembly costs. An example of an integral, monolithic spring is shown in FIGS. 14A and 14B. A monolithic leaf spring 1402 is formed as an integral portion of the lever 608'. The lever 608' is mounted in a channel 622' and is pivotally or rotatably connected to the body 602' by an attachment means 606' and an engagement means 612'. The monolithic spring 1402 is in contact with the channel 622', and deflects downward as shown in FIG. 14B when the upper portion 610' of the lever 608' is moved to its down position. When the upper portion 610' is released, the tension present in the leaf spring 1402 urges the upper portion 610' to its up position, as shown in FIG. 14A.

These embodiments of the present invention may include any of the optional or preferred features of the earlier described embodiments of the present invention. Although the figures show a connector having male conductive projections, it should be recognized that this embodiment of the present invention may also be implemented in a connector having female conductive receivers.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. An ejectable electrical connector assembly, comprising:

a) a male ejectable electrical connector comprising:

i) a first body comprising a first side surface and a first mating surface, the first mating surface having at least one electrically conductive projection extending therefrom, the first body further comprising a first channel extending from the first side surface to the first mating surface, the first side surface having a first attachment means defining a fulcrum about which a lever can pivot;

ii) a first lever disposed in the first channel of the first body, the first lever comprising a first upper portion, a first engagement means, and a first lower portion, the first lever being pivotally attached to said first body by securing the first engagement means to the first attachment means, the first lever having an up position and a down position, the first lever capable of disengaging a female ejectable electrical connector coupled to said the male ejectable electrical connector as the first lever is actuated from the up position to the down position;

iii) wherein the first upper portion of the first lever is maintained in a predetermined position generally apart from the first body and the first lower portion of the first lever is maintained in a predetermined position generally within the first channel, except when the first lever is actuated to disengage the male ejectable connector from a female electrical connector:

iv) a first contacting portion, comprising the first mating surface and the first lower portion of the first lever:

b) a female ejectable electrical connector engaged to the male ejectable electrical connector, comprising:

i) a second body, the second body comprising a second side surface and a second mating surface, the second mating surface having at least one electrically conductive receiver adapted to receive an electrically conductive projection, the second body further comprising a second channel extending from the second side surface to the second mating surface, the second side surface having a second attachment means defining a fulcrum about which a lever can pivot;

ii) a second lever disposed in the second channel of the second body, the second lever comprising a second upper portion, a second engagement means, and a second lower portion the second lever being pivotally attached to the second body by securing the second engagement means to the second attachment means, the second lever having an up position and a down position, said the second lever capable of disengaging a male ejectable electrical connector coupled to the female ejectable electrical connector as the second lever is actuated from the up position to the down position;

iii) wherein the second upper portion of the second lever is maintained in a predetermined position generally apart from the second body and the second lower portion of the second lever is maintained in a predetermined position generally within the second channel, except when the second lever is actuated to disengage the female ejectable connector from the male ejectable electrical connector;

iv) a second contacting portion, comprising the second mating surface and the second lower portion of the second lever; and c) wherein the male ejectable electrical connector is disengaged from the female ejectable electrical connector by actuating at least one of the first and second levers from their respective up positions to their respective down positions such that the first lower portion of the first lever of the male ejectable electrical connector exerts a force upon the second contacting portion of the female ejectable electrical connector and/or the second lower portion of the second lever of the female ejectable electrical connector exerts a force upon the first contacting portion of the male ejectable electrical connector, the forces being sufficient to cause the male ejectable electrical connector and the female ejectable electrical connector to disengage.

2. An ejectable electrical connector assembly as in claim 1, wherein the upper and lower portions of at least one of the levers are maintained in predetermined positions by a biasing means.

3. An ejectable electrical connector assembly as in claim 1, wherein the upper portion of at least one of the first and second levers further comprise a finger pad.

4. An ejectable electrical connector assembly as in claim 2, wherein the finger pad is textured or contoured.

5. A male ejectable electrical connector, configured for engagement with a female electrical connector, comprising:

a) a body, comprising a side surface and a first mating surface, the first mating surface having at least one electrically conductive projection extending therefrom, the body further comprising a channel extending from the side surface to the first mating surface, the side surface having an attachment means defining a fulcrum about which a lever can pivot;

b) a lever disposed in the channel of the body, the lever comprising an upper portion, an engagement means, and a lower portion, the lever being pivotally attached to the body by securing the engagement means to the attachment means, the lever having an up position and a down position, the lever capable of disengaging a female electrical connector coupled to the male ejectable electrical connector as the lever is actuated from the up position to the down position; and c) wherein the upper portion of the lever is maintained in a predetermined position generally apart from the body and the lower portion of the lever is maintained in a predetermined position generally within the channel, except when the lever is actuated to disengage the male ejectable electrical connector from the female electrical connector.

6. A male ejectable electrical connector as in claim 5, wherein the upper and lower portions of the lever are maintained in predetermined positions by a biasing means.

7. A male ejectable electrical connector as in claim 5, wherein the body further includes:

a) a second mating surface; and b) a female electrical connector located at the second mating surface, the female electrical connector having at least one electrically conductive receiver adapted to receive an electrically conductive projection, the electrically conductive receiver being in electrical communication with the electrically conductive projection of the first mating surface.

8. A male ejectable electrical connector as in claim 5, wherein the upper portion of the lever further comprises a finger pad.

9. A male ejectable electrical connector as in claim 8, wherein finger pad is textured or contoured.

10. A female ejectable electrical connector, configured for engagement with a male electrical connector, comprising:

a) a body, comprising a side surface and a mating surface, the mating surface having at least one electrically conductive receiver adapted to receive an electrically conductive projection, body further comprising a channel extending from the side surface to the mating surface, the side surface having an attachment means defining a fulcrum about which a lever can pivot;

b) a lever disposed in the channel of the body, the lever comprising an upper portion, an engagement means, and a lower portion, the lever being pivotally attached to the body by securing the engagement means to the attachment means, the lever having an up position and a down position, the lever capable of disengaging a male electrical connector coupled to the female ejectable electrical connector as the lever is actuated from the up position to the down position; and c) wherein the upper portion of the lever is maintained in a predetermined position generally apart from the body and the lower portion of the lever is maintained in a predetermined position generally within the channel, except when the lever is actuated to disengage the female ejectable connector from the male electrical connector.

11. A female ejectable electrical connector as in claim 10, wherein the upper and lower portions of the lever are maintained in predetermined positions by a biasing means.

12. A female ejectable electrical connector as in claim 10, wherein the upper portion of the lever comprises a finger pad.

13. A female ejectable electrical connector as in claim 12, wherein the finger pad is textured or contoured.

14. An extension cord having at least one ejectable electrical connector, comprising:

a) an electrical cable having a first end and a second end;

b) a first male connector electrically conductively attached to the first end of the electrical cable;

a female ejectable electrical connector electrically conductively attached to the second end of the electrical cable, the female ejectable electrical connector comprising:

i) a body, comprising a side surface and a mating surface, the mating surface having at least one electrically conductive receiver adapted to receive an electrically conductive projection, body further comprising a channel extending from the side surface to the mating surface, the side surface having an attachment means defining a fulcrum about which a lever can pivot; and ii) a lever disposed in the channel of the body, the lever comprising an upper portion, an engagement means, and a lower portion, the lever being pivotally attached to the body by securing the engagement means to the attachment means, the lever having an up position and a down position, the lever capable of disengaging a second male electrical connector coupled to the female ejectable electrical connector as the lever is actuated from the up position to the down position;

iii) wherein the upper portion of the lever is maintained in a predetermined position generally apart from the body and the lower portion of the lever is maintained in a predetermined position generally within the channel, except when the lever is actuated to disengage the female ejectable connector from the second male electrical connector.

15. An extension cord as in claim 14, wherein the upper and lower portions of the lever are maintained in predetermined positions by a biasing means.

16. An extension cord as in claim 14, wherein the upper portion of the lever comprises a finger pad.

17. An extension cord as in claim 16, wherein the finger pad is textured or contoured.

18. An extension cord having at least one ejectable electrical connector, comprising:

a) an electrical cable having a first end and a second end;

b) a first female connector electrically conductively attached to the first end of the electrical cable;

c) a first male ejectable electrical connector electrically conductively attached to the second end of the electrical cable, comprising:

i) a body, comprising a side surface and a mating surface, the mating surface having at least one electrically conductive projection extending therefrom, the body further comprising a channel extending from the side surface to the mating surface, the side surface having an attachment means defining a fulcrum about which a lever can pivot; and ii) a lever disposed in the channel of the body, the lever comprising an upper portion, an engagement means, and a lower portion, the lever being pivotally attached to the body by securing the engagement means to the attachment means, the lever having an up position and a down position, the lever capable of disengaging a second female electrical connector coupled to the first male ejectable electrical connector as the lever is actuated from said; the up position to the down position;

iii) wherein the upper portion of the lever is maintained in a predetermined position generally apart from the body and the lower portion of the lever is maintained in a predetermined position generally within the channel, except when the lever is actuated to disengage the first male ejectable connector from the second female electrical connector.

19. An extension cord as in claim 18, wherein the upper and lower portions of the lever are maintained in predetermined positions by a biasing means.

20. An extension cord as in claim 18, wherein the upper portion of the lever comprises a finger pad.

21. An extension cord as in claim 20, wherein, the finger pad is textured or contoured.

22. An extension cord as in claim 18, wherein the first female connector is a female ejectable electrical connector comprising:

a) a body, comprising a side surface and a mating surface, the mating surface having at least one electrically conductive receiver adapted to receive an electrically conductive projection, the body further comprising a channel extending from the side surface to the mating surface, the side surface having an attachment means defining a fulcrum about which a lever can pivot; and b) a lever disposed in the channel of the body, the lever comprising an upper portion, an engagement means, and a lower portion, the lever being pivotally attached to the body by securing the engagement means to the attachment means, the lever having an up position and a down position, the lever capable of disengaging a second male electrical connector coupled to the female ejectable electrical connector as the lever is actuated from the up position to the down position;

c) wherein the upper portion of the lever is maintained in a predetermined position generally apart from the body and the lower portion of the lever is maintained in a predetermined position generally within the channel, except when the lever is actuated to disengage the female ejectable connector from the second male electrical connector.

23. An extension cord as in claim 22, wherein the upper and lower portions of the lever are maintained in predetermined positions by a biasing means.

24. An extension cord as in claim 22, wherein the upper portion of the lever comprises a finger pad.

25. An extension cord as in claim 24, wherein the finger pad is textured or contoured.

26. A method for disengaging electrical connectors, which comprises:

a) applying a force to at least one lever disposed in at least one of the electrical connectors, b) wherein an upper portion of the lever is resiliently maintained in a predetermined position generally apart from an associated body of the electrical connector and a lower portion of the lever is resiliently maintained in a predetermined position generally within a channel of the body except when the lever is actuated to disengage the electrical connectors, and c) the force is sufficient to pivot the upper portion of the lever toward the body and to pivot the lower portion of the lever outwardly from the channel such that the lever acts to disengage the electrical connectors.

27. A method for disengaging electrical connectors, which comprises:

a) displacing at least one lever disposed in at least one of the electrical connectors, b) wherein an upper portion of the lever is resiliently maintained in a predetermined position generally apart from an associated body of the electrical connector and a lower portion of the lever is resiliently maintained in a predetermined position generally within a channel of the body except when the lever is actuated to disengage the electrical connectors, and c) the displacement causes the upper portion of the lever to pivot toward the body and the lower portion of the lever to pivot outwardly from the channel, causing the electrical connectors to disengage.

* * * * *

UNITED STATES PATENT AND TRADEMARK OFFICE

CERTIFICATE OF CORRECTION

PATENT NO. : 6,716,044 B2
DATED : April 6, 2004
INVENTOR(S) : Patrick J. Bertke

It is certified that error appears in the above-identified patent and that said Letters Patent is hereby corrected as shown below:

Title page,
Item [57], ABSTRACT,
Line 10, delete the word “not” (second occurrence).

Column 11,
Line 42, change the word “said” to -- the --.
Line 47, delete the word “said”.

Column 12,
Line 12, delete the word “said”.
Line 49, change numeral “2” to -- 3 --.

Signed and Sealed this

Sixth Day of July, 2004

JON W. DUDAS
*Acting Director of the United States Patent and Trademark Office*

US006716044C1

(12) INTER PARTES REEXAMINATION CERTIFICATE (0193rd)

United States Patent

Bertke

(10) Number: US 6,716,044 C1

(45) Certificate Issued: Oct. 12, 2010

(54) EJECTABLE ELECTRICAL CONNECTOR AND METHOD OF USE

(75) Inventor: Patrick J. Bertke, Columbus, OH (US)

(73) Assignee: Trident Design LLC, Columbus, OH (US)

Reexamination Request:
No. 95/000,508, Nov. 17, 2009

Reexamination Certificate for:

| | |
|---|---|
| Patent No.: | **6,716,044** |
| Issued: | **Apr. 6, 2004** |
| Appl. No.: | **10/266,441** |
| Filed: | **Oct. 8, 2002** |

Certificate of Correction issued Jul. 6, 2004.

Related U.S. Application Data

(63) Continuation-in-part of application No. 09/901,248, filed on Jul. 9, 2001, now abandoned.

(51) Int. Cl.
*H01R 13/633* (2006.01)

(52) U.S. Cl. ..... 439/160; 439/159

(58) Field of Classification Search ..... None
See application file for complete search history.

(56) References Cited

U.S. PATENT DOCUMENTS 2,051,425 A 8/1936 Schluma

FOREIGN PATENT DOCUMENTS

| | | |
|---|---|---|
| CN | 2032365 | 2/1989 |
| TW | 352868 | 2/1999 |

*Primary Examiner*—P. Tibbits

(57) ABSTRACT

The present invention provides a device and method for separating electrical connector assemblies. Electrical connector assemblies typically comprise a male connector, commonly called a plug, and a female connector, commonly called a receptacle. The separation of an electrical connector assembly is accomplised by at least one lever disposed in the body of at least one of the connectors. The lever is attached to the body of the connector such that when the lever is "up" the lower portion of the lever is flush with the mating surface so as not to interface with the coupling of the connector. Actuation of the lever, i.e., moving the lever to its down position, causes a displacement of at least one of the connectors comprising the electrical connector assembly. The present invention may be adapted to a wide range of electrical connectors including, but not limeted to: standard household plug and sockets, parallel connectors, serial connectors, and inline connectors.

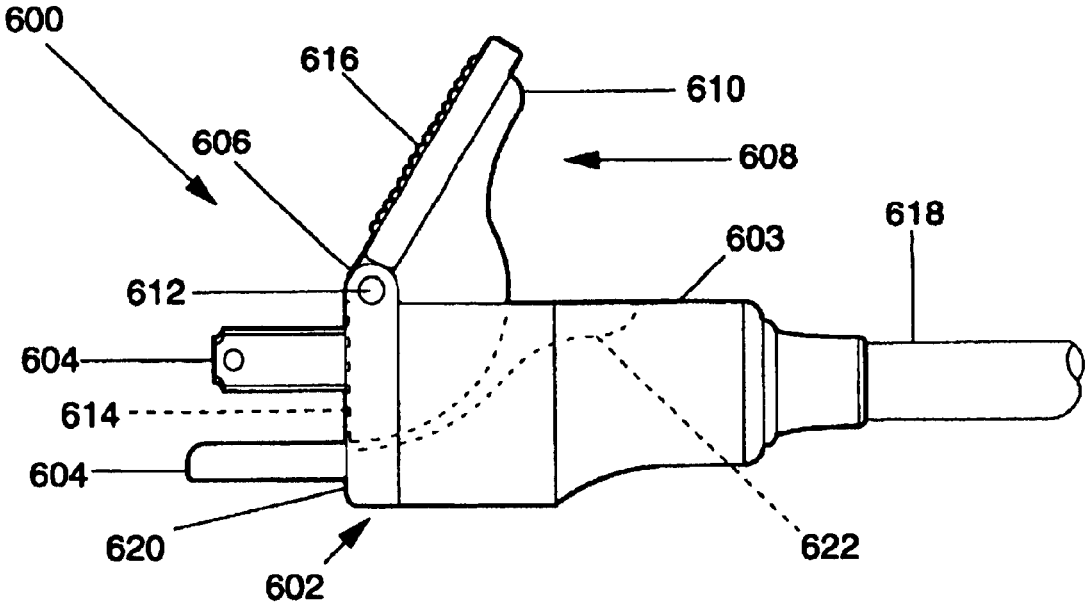

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-27 are cancelled.

* * * * *